United States Patent [19]

Floreen

[11] 4,013,458

[45] Mar. 22, 1977

[54] CAST MARAGING STEEL

[75] Inventor: Stephen Floreen, Suffern, N.Y.

[73] Assignee: The International Nickel Company, Inc., New York, N.Y.

[22] Filed: Dec. 30, 1975

[21] Appl. No.: 645,451

Related U.S. Application Data

[63] Continuation-in-part of Ser. No. 479,812, June 17, 1974, abandoned.

[52] U.S. Cl. ..... 75/124; 75/123 J; 75/123 K; 75/123 L; 75/123 M

[51] Int. Cl.[2] ..... C22C 38/06; C22C 38/08; C22C 38/10

[58] Field of Search ..... 75/124, 123 K, 123 M, 75/123 J, 123 R, 123 L; 148/31

[56] References Cited

UNITED STATES PATENTS

| | | | |
|---|---|---|---|
| 3,093,519 | 6/1963 | Decker et al. | 148/31 |
| 3,132,937 | 5/1964 | Sadowski et al. | 75/124 |
| 3,132,938 | 5/1964 | Decker et al. | 75/124 |
| 3,294,527 | 12/1966 | Floreen et al. | 75/123 K |
| 3,532,491 | 10/1970 | Floreen et al. | 75/123 K |

*Primary Examiner*—Arthur J. Steiner
*Attorney, Agent, or Firm*—Raymond J. Kenny; Ewan C. MacQueen

[57] ABSTRACT

A cast maraging steel containing correlated percentages of nickel, cobalt, molybdenum, silicon, aluminum, titanium, carbon and titanium as well as iron.

5 Claims, No Drawings

CAST MARAGING STEEL

The subject invention is addressed to cast maraging steels, and is a continuation-in-part of my copending application Ser. No. 479,812, filed June 17, 1974, now abandoned.

As those skilled in the art are aware, more than a decade has passed since the advent of the maraging steels. During that period, these steels, at least those in the wrought condition, achieved a position of prominence in various areas of appliation. But, all their attributes notwithstanding, the cast versions have apparently disappeared from the commercial scene. Perhaps the reason for this was largely occasioned by the necessity to vacuum melt and vacuum pour in an effort to achieve a satisfactory combination of properties. Of course, this would increase cost markedly. It would appear, therefore, that cast maraging steels which could be produced in accordance with air melting technology but capable of delivering a satisfactory combination of metallurgical characteristics, notably strength and toughness, would become a more formidable competitor in the marketplace.

It has now been found that vacuum processing can be dispensed with and that a high level of strength and toughness can be attained using air melting processing provided the cast steels contain special amounts of nickel, cobalt, molybdenum, silicon, aluminum, titanium and carbon.

Generally speaking, and in accordance with the present invention, cast maraging steels are contemplated which contain from about 15 to 19% nickel, from about 8 or 9% to about 11 or 11.5% cobalt, about 1.5 to 2.5% molybdenum, 0.01 to 0.2% of each of aluminum and titanium, from 0.3 to 0.6% silicon, 0.001 to 0.1%, e.g., 0.005 to 0.05% carbon, the balance being essentially iron. Such steels consistently afford a minimum yield strength of at least 175,000 or 180,000 psi together with the capability of absorbing high levels of impact energy.

With regard to the chemistry above given, it is noteworthy to mention that the steels contain, comparatively speaking, a rather substantial amount of silicon. Heretofore, it has been deemed that silicon was detrimental, particularly in respect of toughness. Indeed, in speaking of maraging steels in general, it has been said that the silicon content thereof should be held to a maximum of 0.1%. However, as will be shown herein, provided that cast maraging steels contain the proper constituents, the percentages of which are particularly correlated, not only can high strength levels be achieved, but more than satisfactory toughness as well.

Of considerable importance, since the instant steels accept high silicon levels, less pure materials can be used in production, thus offering a further economic advantage commercially. The silicon can be extended down to 0.1% with the cobalt level of about 11.5%.

The following illustrative data are given.

A series of steels were prepared in accordance with the invention using conventional air melting techniques. In this regard, 30-lb. air induction melts were made using electrolytic type charge materials. The melts were cast into one-inch thick keel block sand molds. Tensile, Charpy V-notch impact and, in some instances, fracture toughness tests were conducted, these tests being performed at room temperature. The compositions of various steels are given in Table I, Alloys 1–6 being within the invention whereas Alloys A–F are beyond the scope thereof.

TABLE I

| Alloy | Ni % | Co % | Mo % | Si % | Al % | Ti % | C % | Fe |
|---|---|---|---|---|---|---|---|---|
| 1 | 18.1 | 10.2 | 2.0 | .30 | .04 | .04 | .019 | Bal. |
| 2 | 17.9 | 10.5 | 1.6 | .36 | .03 | .06 | .021 | Bal. |
| 3 | 18.0 | 8.1 | 2.1 | .35 | .02 | .06 | .031 | Bal. |
| 4 | 17.9 | 8.4 | 1.7 | .42 | .02 | .07 | .047 | Bal. |
| 5 | 17.8 | 10.4 | 1.62 | .41 | .05 | .04 | .019 | Bal. |
| 6 | 17.8 | 10.1 | 1.75 | .48 | .03 | .04 | .004 | Bal. |
| A | 17.6 | 15.3 | 2.6 | .45 | .03 | .02 | .015 | Bal. |
| B | 17.9 | 15.4 | 2.5 | .33 | .04 | .04 | .039 | Bal. |
| C | 12.0 | 12.4 | 2.1 | .03 | .01 | .04 | .009 | Bal. |
| D | 18.2 | 4.2 | 2.55 | .23 | .02 | .04 | .011 | Bal. |
| E | 17.9 | 6.3 | 1.52 | .36 | .02 | .05 | .010 | Bal. |
| F | 18.1 | 6.2 | 2.30 | .36 | .02 | .07 | .009 | Bal. |

The alloys were subjected to a heat treatment consisting of (i) solution annealing at 2100° F. for 1 hour, air cooling, (ii) heating at 1100° F. for 1 hour, air cooling, (iii) followed by heating at 1500° F. for 1 hour and air cooling, the alloys thereafter being (iv) aged at 900° F. for 3 hours. The results of these tests are reported in Table II below.

TABLE II

| Alloy | Yield Strength 0.2% offset, ksi | UTS ksi | Elong. % | R.A. % | CVN ft-lbs. |
|---|---|---|---|---|---|
| 1 | 197 | 204 | 10 | 47 | 25.7 |
| 2 | 190 | 194 | 14 | 57 | 27.5 |
| 3 | 193 | 198 | 11 | 38 | 24.2 |
| 4 | 190 | 194 | 12 | 52 | 22.2 |
| 5 | 189 | 198 | 12 | 53 | 19 |
| 6 | 187 | 194 | 15 | 61 | 27.8 |
| A | 241 | 251 | 8 | 33 | 5.2 |
| B* | 260 | 271 | 2 | 4 | 4.0 |
| C | 141 | 154 | 10 | 32 | 14.7 |
| D | 169 | 176 | 14 | 49 | 20.5 |
| E | 149 | 158 | 18 | 64 | 47.0 |
| F | 163 | 177 | 15 | 55 | 34.5 |

*Aged at 800° F. for 24 hours

The data reported in Tables I and II reflect the disadvantages in appreciably departing from the cast steel compositions in accordance herewith. For example, Alloys A and B had much higher cobalt levels (the molybdenum also being at the high end of its alloying range) than need be. And while strength was high, tensile ductility and toughness were relatively low. On the other hand, whereas ductility and toughness were acceptable in respect of, say, Alloys E and F, strength was unsatisfactory.

The foregoing data indicate that provided a properly correlated chemical balance is employed, "cast maraging" steels can be produced with a quite acceptable combination of strength and toughness, this obtaining with air melting processing.

It might also be added that it is of significance that steels in accordance herewith combine the capability of offering high strength, e.g., 180,000 psi and above in thick sections. As indicated in a recent National Advisory Board Report, such a cast steel would be desirable. It was indicated that, subject to further development work, even HY-180 probably would have to be vacuum melted. In this regard, a 300 lb. air induction melt of the following composition was sand cast into not only one and three inch castings, but also a six inch thick casting with good results (193 KSI Y.S. plus 34 CVN at room temperature): 17.7% nickel, 10.1% cobalt, 1.61% molybdenum, 0.28% silicon, 0.01% aluminum, 0.04% titanium, 0.009% carbon, balance iron and impurities.

A particularly satisfactory cast alloy contains 16.5 to 18% nickel, 9.75 to 11% cobalt, 1.6 or 1.7 to 2.1% molybdenum, 0.01 to 0.1% each of aluminum and titanium, about 0.3 to 0.6% silicon, about 0.01 to 0.05% carbon and the balance essentially iron.

Although the invention has been described in connection with preferred embodiments, modifications may be resorted to without departing from the spirit and scope of the invention, as those skilled in the art will readily understand. Such are considered within the purview and scope of the invention and appended claims.

I claim:

1. An air-melted maraging steel in cast form having a yield strength in excess of 175,000 psi, together with good ductility and toughness consisting of about 15 to 19% nickel, from 9 to about 11% cobalt, about 1.5 to 2.5% molybdenum, 0.01 to 0.1% of each of aluminum and titanium, from 0.3 to 0.6% silicon, and up to 0.1% carbon, the balance being essentially iron.

2. A maraging steel in cast form having a yield strength in excess of 175,000 psi, together with good ductility and toughness consisting of about 16.5 to 18% nickel, 9.75 to 11% cobalt, 1.6 to 2.1% molybdenum, 0.02 to 0.1% each of aluminum and titanium, about 0.3 to 0.6% silicon, 0.01 to 0.05% carbon and the balance essentially iron.

3. A maraging steel as set forth in claim 2 and consisting of about 18% nickel, about 8.1% cobalt, about 2.1% molybdenum, about 0.35% silicon, about 0.02% aluminum, about 0.06% titanium, about 0.031% carbon with the balance being essentially iron.

4. A cast maraging steel in accordance with claim 2 and consisting of about 17.9% nickel, about 8.4% cobalt, about 1.7% molybdenum, about 0.42% silicon, about 0.02% aluminum, about 0.07% titanium, about 0.047% carbon, with the balance being essentially iron.

5. An air-melted maraging steel in the cast form having a yield strength of about 193,000 ksi and a Charpy V-notch impact strength at room temperature of about 34 foot pounds, said steel consisting of about 17.7% nickel, about 10.1% cobalt, about 1.61% molybdenum, about 0.28% silicon, about 0.01% aluminum, about 0.04% titanium, about 0.009% carbon, with the balance being essentially iron.

* * * * *